US007387471B2

(12) United States Patent
Heindl et al.

(10) Patent No.: US 7,387,471 B2
(45) Date of Patent: Jun. 17, 2008

(54) COMBINATION PILE WALL

(75) Inventors: Richard Heindl, Munich (DE); Rob. R. Wendt, Rapid City, SD (US); Georg Wall, Munich (DE)

(73) Assignee: Pilepro, LLC, Austin, TX (US)

( * ) Notice: Subject to any disclaimer, the term of this patent is extended or adjusted under 35 U.S.C. 154(b) by 6 days.

(21) Appl. No.: 11/346,013

(22) Filed: Feb. 2, 2006

(65) Prior Publication Data

US 2006/0179771 A1 Aug. 17, 2006

(30) Foreign Application Priority Data

Feb. 2, 2005 (EP) ..... 05002205

(51) Int. Cl.
*E02D 5/02* (2006.01)

(52) U.S. Cl. ..... 405/274; 405/277; 405/278; 405/279; 405/281; 405/285

(58) Field of Classification Search ..... 405/274, 405/275, 277–281, 285
See application file for complete search history.

(56) References Cited

U.S. PATENT DOCUMENTS 985,150 A * 2/1911 Evennette ..... 405/277
1,098,077 A * 5/1914 Annison ..... 405/279
1,851,864 A * 3/1932 Nolte ..... 405/279
1,855,113 A * 4/1932 Nolte ..... 405/14
1,918,886 A * 7/1933 Amand ..... 405/279
2,018,625 A * 10/1935 Otto ..... 405/277
5,292,208 A * 3/1994 Berger ..... 405/281
6,000,883 A * 12/1999 Irvine et al. ..... 405/281
6,042,306 A * 3/2000 Arndts et al. ..... 405/279
6,428,244 B1 * 8/2002 Wall ..... 405/279
D463,578 S * 9/2002 Wall ..... D25/121
D471,794 S * 3/2003 Wall ..... D8/382
D472,455 S * 4/2003 Wall ..... D8/382
6,575,667 B1 * 6/2003 Burt et al. ..... 405/287
D479,983 S * 9/2003 Wall ..... D8/382
D521,364 S * 5/2006 Wall ..... D8/382
D543,100 S * 5/2007 Heindl ..... D8/382
2005/0238443 A1 * 10/2005 Heindl et al. ..... 405/277
2007/0003379 A1 * 1/2007 Wall ..... 405/279
2007/0077129 A1 * 4/2007 Hermes et al. ..... 405/278

FOREIGN PATENT DOCUMENTS

DE 297 18 052 U1 3/1997
DE 103 18 769 A1 4/2003
EP 0 072 118 A1 7/1982

* cited by examiner

*Primary Examiner*—Tara L. Mayo
(74) *Attorney, Agent, or Firm*—Milde & Hoffberg, LLP

(57) ABSTRACT

A combination pile wall is formed of beam elements (12), particularly T-beams and double-T-beams (I-beams), and shaped connection strips (16) directly or indirectly connecting the beam elements (12), whereby each shaped connection strip (16) that is coupled directly with one of the beam elements (12) is engaged with one of the locking elements (30) formed on the respective beam element (12). The two mutually-engaged locking elements (24, 26) of the shaped connection strip (16) and of the beam element (12) are configured with a cross section such that the two locking elements (24, 26) may pivot with respect to each other through an angular range of a minimum ±3° to a maximum ±10°.

14 Claims, 4 Drawing Sheets

COMBINATION PILE WALL

BACKGROUND OF THE INVENTION

The invention concerns a combination pile wall, and more particularly a pile wall comprising a plurality of adjacent pile wall beam elements interconnected by connecting elements and possibly also sheet pile elements.

Combination pile walls of the aforesaid type are known from DE 297 18 052 U1, EP 0 072 118 A1, or also DE 103 18 769 A1; they are used to reinforce banks of harbors and rivers, to support a dam, or to erect quay walls and the like. The known combination pile walls are formed of beam elements such as double-T beams (I-beams), with connection shaped strips (connecting elements) connected directly to them which are intended to ensure at least an approximately water-tight seal between the beam elements. The shaped connection strips are equipped with locking elements that engage with matching locking elements on the beam elements. If the loads on the combination pile walls from the soil are moderate, at least one sheet pile, called a "fill pile", is positioned between each pair of adjacent beam elements so that the number of beam elements used in the pile wall, that are responsible for the resistance moment of the wall, may be reduced. In order to form a locked, water-tight pile wall, the sheet piles are also coupled together along their longitudinal edges by locking elements such as hook or claw strips, while the sheet piles positioned directly adjacent to the beam elements are connected with the beam elements by means of the shaped connection strips. The shaped connection strips are also equipped with suitable locking elements for this purpose.

The problem with known combination pile walls is that the locking elements engaged with one another are either so manufactured that they may hardly move with respect to one another, or the locking elements are so shaped that they may pivot over a wide angular range of up to ±45°. If the individual beam elements between which sheet piles are positioned as necessary are driven into the ground, there is a danger that, for those joints in which the locking elements allow practically no movement with respect to one another, the locking elements will become disengaged at least in sections or that the joints will break completely. On the one hand, this causes the vertical stability and stiffness of the overall combination pile wall to be negatively influenced while, on the other, it allows passage of water through the combination pile wall because the sections are damaged or are no longer engaged. If, in contrast, combination pile walls are used where the locking elements allow large pivot angles, the beam elements and sheet piles may deviate from each other when driven into the ground, moving out of their intended positions, so that an exact positioning of the combination pile wall is made more difficult.

SUMMARY OF THE INVENTION

A principal object of the present invention is to provide a combination pile wall that ensures exact positioning of the individual components while maintaining adequate vertical stability and water sealing characteristics.

This object, as well as further objects and advantages that will occur to those skilled in the art, are achieved, according to the present invention, by configuring the two interconnecting locking elements of the shaped connection strip and of the beam element such that, viewed in cross section, the two locking elements may be pivoted with respect to each other through an angular range ($\alpha$) of a minimum ±3° to a maximum ±10°.

In the combination pile wall according to the invention, the beam elements are connected together by means of shaped connection strips whose locking elements are so shaped that they permit the beam element, with its locking element inserted into the locking element of the connection strip, to pivot through an angular range of at least ±3°. This ensures that any relative movement of the beam elements with respect to one another may be compensated for when being driven, and disengagement or release of the respective locking elements of the shaped connection strip and the beam element, or damage to the locking elements, is practically prevented. On the other hand, the locking elements are shaped so as to limit the pivot angle to ±10°, allowing relative movement of the respective locking elements of the shaped connection strip and of the beam element up to this maximum angle, while ensuring the desired, relatively exact positioning of the combination pile wall overall. The ability of the locking elements, which are engaged with one another, to pivot is limited at this maximum angle when the locking elements rest against one another along at least two points or lines of contact.

In order to achieve the most exact positioning of the combination pile wall, it is recommended, in an advantageous embodiment of the invention, to limit the permissible angle range, through which the beam element and the shaped connection strip engaged with it may be pivoted, to a maximum permissible angle of ±7°, while maintaining a minimum ability to pivot at an angle of ±3° as before.

Especially preferred is a shaped connection strip used with so-called "beam carriers", or double-T beams (I-beams), for which each end of the T-beams possesses a securing section that is wedge-shaped in cross-section. To secure the shaped connection strip to a beam element such as a beam carrier, the shaped connection strip includes two securing strips preferably with a cross section that projects from a central strip as a locking element, between which the beam element with the securing section possessing a wedge-shaped cross section is to be inserted, while the second of the securing strips projects toward the first securing strip from the central strip at an angle. The separation and the progression of the securing strips from the wedge-shaped section of the beam element are so shaped that the shaped connection strip may be pivoted relative to the beam element through an angular range of ±3° to ±10°, preferably from ±3° to ±7°.

In an alternative embodiment of the pile wall according to the invention, in which conventional double T-beams or T-beams are used as beam elements, the shaped connection strip possesses two securing strips preferably projecting from a central strip when seen in cross section and approximately parallel to each other between which the beam element with its approximately rectangular section is inserted.

In order to erect combination pile walls that, on one hand, display a high degree of vertical stability and, on the other hand, have a reduced, minimum number of beam elements necessary for the desired resistance moment of the combination pile wall, a preferred embodiment of the combination pile wall according to the invention comprises a sheet pile, preferably a Z-sheet pile or a U-sheet pile, positioned between each adjacent beam element that is coupled with shaped connection strips secured on the beam elements.

In order to simplify the construction of pile walls equipped with beam elements and sheet piles, it is advantageous to form a second locking element on the shaped connection strip coupled with the sheet pile that engages with one of the locking elements formed on the sheet pile. The engaged locking elements of the shaped connection strip and the sheet pile are preferably configured with a cross section allowing both locking elements to pivot through an angular range of at least ±3° to ±10° with respect to each other, preferably through an angular range with a maximum of ±7°.

In a particularly advantageous variation of this embodiment of the pile wall according to the invention, it is further proposed to use shaped connection strips to connect the sheet piles with the beam elements that are provided with C-shaped claw strips along their entire lengths. The C-shaped configuration of the connection element ensures secure attachment of the locking element of the sheet pile equipped with the claw strip, for example a head strip with an oval cross section. For this, the locking element of the sheet pile is inserted axially into the claw strip when it is being driven, whereby the locking element itself is partially surrounded by the claw strip, while the C-shaped configuration of the claw strip simultaneously allows the desired pivoting ability of the locking element of the sheet pile within the claw strip.

If, in contrast, a pile wall for which the locking element is formed as a claw strip with C-shaped cross section is connected with the adjacent beam elements, a shaped connection strip is preferably used that includes a head strip with oval cross section that may be inserted into the locking element of the sheet pile configured with C-shaped cross section. This ensures an adequate amount of pivot capability of the sheet pile relative to the beam.

The two basic forms of the locking elements of the shaped connection strip previously described represent only potential configurations. The locking elements of the shaped connection strip may basically possess other cross-sectional shapes as long as the limited ability to pivot, for the locking element of the beam element, or the locking elements of the pile wall within each locking element of the shaped connection strip, is ensured.

If larger sections are to be reinforced by the combination pile wall, several sheet piles may be inserted between each adjacent pair of beam elements, which form pile wall sections by means of locks connected with one another.

At least two sheet piles positioned directly adjacent to each other may preferably be connected together by means of a central sliding lock which is provided with two locking elements that engage with the complementary locking elements on both sheet piles. This results in particularly high flexibility for the formation and progression of the pile wall formed by the sheet piles.

The central sliding lock is preferably so shaped that the locking elements of the central sliding lock and the locking elements of the two sheet piles connected with each other may be pivoted with respect to each other at an angle of at least ±3° to a maximum ±10°, and preferably at an angle of ±3° to a maximum ±7°.

In order to ensure the desired flexibility as the combination pile wall is constructed, the central slide lock of a particularly advantageous embodiment includes two claw strips with C-shaped cross sections facing in opposing directions into which the sheet piles may be hung by means of their locking elements.

In order to be able to support the pile wall in the area of the central slide lock, as necessary, it is further proposed to provide an additional connecting strip on the central slide lock to which suitable support elements such as additional T-beams may be used with the combination pile wall. If the central slide lock is provided with the above-mentioned C-shaped claw strips, it is of particular advantage if the connection strip extends approximately perpendicular to the directions of the two C-shaped claw strips with respect to the central slide lock.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
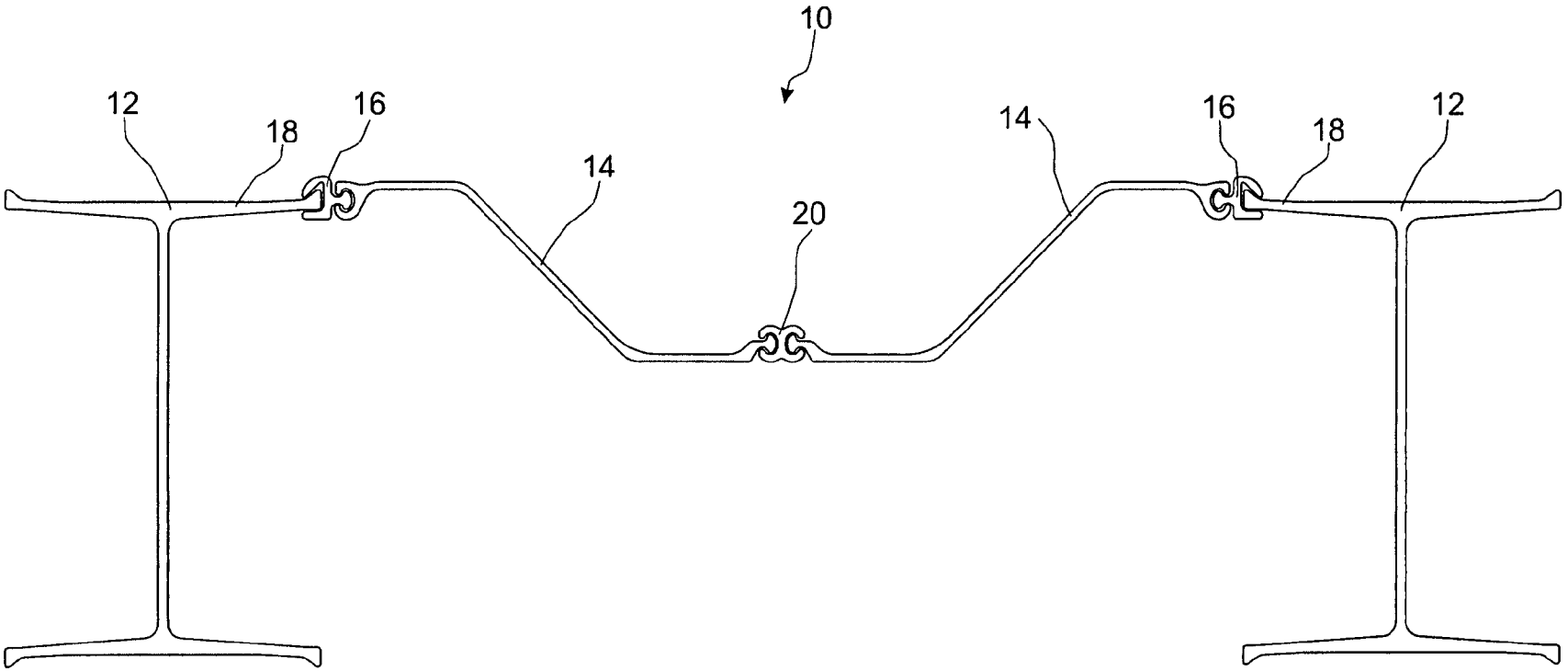
FIG. 1 is a top view of a first embodiment of a wall section of a combination pile wall according to the invention consisting of beam carriers and Z-sheet piles connected together by means of a central slide lock.

The preferred embodiments of the present invention will now be described with reference to FIGS. 1-5 of the drawings. Identical elements in the various figures are designated with the same reference numerals.

FIG. 1 shows a top view of a first embodiment of a wall section of a combination pile wall 10 according to the invention. The combination pile wall 10 in this case is formed of two claimed beam carriers 12 between which two Z-shaped sheet piles 14 are inserted. Instead of the two Z-shaped sheet piles coupled together, a single U-shaped sheet pile may, for example, be used. A shaped connection strip 16 is positioned between each sheet pile 14 and each beam carrier 12 with one end of its two T-beams 18 and the sheet pile 14 suspended by their longitudinal edges. The two other longitudinal edges of the sheet piles 14 are hung on one common central slide lock 20. Both the shaped connection strip 16 and the central slide lock 20 possess a constant cross section, and are matched in length to the lengths of the beam carriers 12 and of the sheet piles 14.

Figure 2:
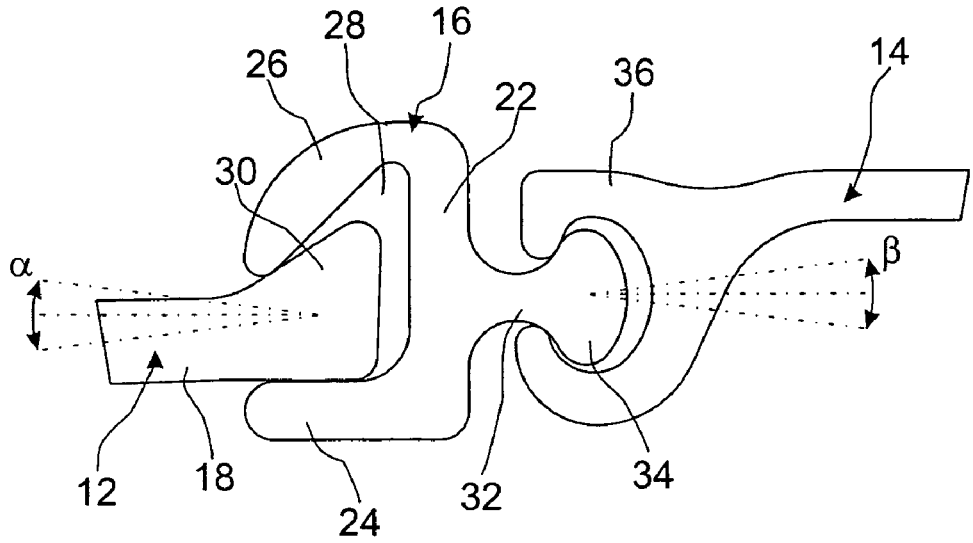
FIG. 2 is an enlarged view of a shaped connection strip by means of which one of the Z-sheet piles of the combination pile wall is secured to one of the beam carriers.

FIG. 2 shows an enlarged view of a section of the combination pile wall 10 in which the beam carrier 12, on the left side of FIG. 1, is shown with the shaped connection strip 16 connecting with the sheet pile 14. The shaped connection strip 16 includes a central strip 22 from one end of which a first securing strip 24 projects at a right angle. A second securing strip 26 projects from the other end of the central strip 22 in the same direction, extending at an angle of about 45° toward the first securing strip 24, and ending at about the same height. This forms a receiver channel 28 with triangular cross section that is open on its side facing away from the tapered central strip 22.

One end of the T-beam 18 is inserted into the receiver channel 28 of the beam carrier 12. In order to prevent the T-beam 18 from slipping out of the receiver channel 28, the cross section of the end of the T-beam 18 is expanded into a wedge-shaped securing section 30. The receiver channel 28 and the securing section 30 are of such dimensions that the shaped connection strip 16 may be pivoted through an angular range a of at least ±3° and an angular range with a maximum ±7° with respect to the T-beam, as shown in FIG. 2. Pivoting movement ceases as soon as the outer profile of the securing section 30 rests on at least two contact lines against the inner profile of the receiver channel 28.

A neck strip 32 projects at a right angle from the opposing flat side of the central strip 22 approximately in the center as a connection element on whose end a head strip 34 with oval cross section is formed. The oval head strip 34 is received in a claw strip 36 with a C-shaped cross-section that is shaped on one end of the one sheet pile 14. The oval head strip 34 and the claw strip 36 are here also configured and shaped such that the sheet pile 14 and the shaped connection strip 16 may be pivoted at least through an angle range β of at least ±3° and an angular range of a maximum ±7° relative to each other, as FIG. 2 shows. The pivoting movement also ends here when the outer profile of the head strip 34 rests against the inner profile of the C-shaped claw strip 36 along at least two contact lines.

Figure 3:
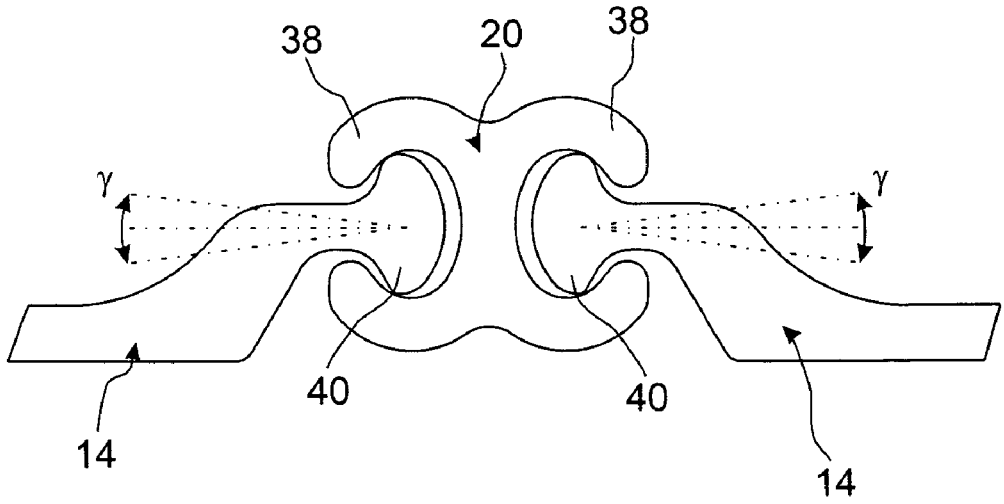
FIG. 3 is an enlarged view of the central slide lock that connects two Z-sheet piles of the combination pile wall.

FIG. 3 shows an enlarged view of the central slide lock 22 with two suspended sheet piles 14. The central slide lock 22 includes two claw strips 38 pointing in opposing directions with C-shaped cross section, each of which surround the locking elements of one of the two sheet piles 14 formed as a head strip 40. Here too, the claw strips 38 of the central slide lock 22 and the head strips 40 of the two sheet piles 14 are configured and dimensioned such that the central slide lock 22 may be pivoted through an angular range γ of at least ±3° up to a maximum ±7° with respect to each sheet pile 14. This pivoting movement ends when each of the head strips 40 on the central slide lock 22 rests against at least two contact lines.

Limited ability of the beam carriers 12 and the sheet piles 14 relative to the shaped connection strips 16 and the central slide lock 22 to pivot prevents, on the one hand, the locking elements such as the head strips 34 and 40 from jumping out the C-shaped claw strips 36 and 38 since the locking elements may only move to a limited extent with respect to each other while, on the other hand, proper construction of the combination pile wall 10 is possible up to a maximum ±7°.

Figure 4:
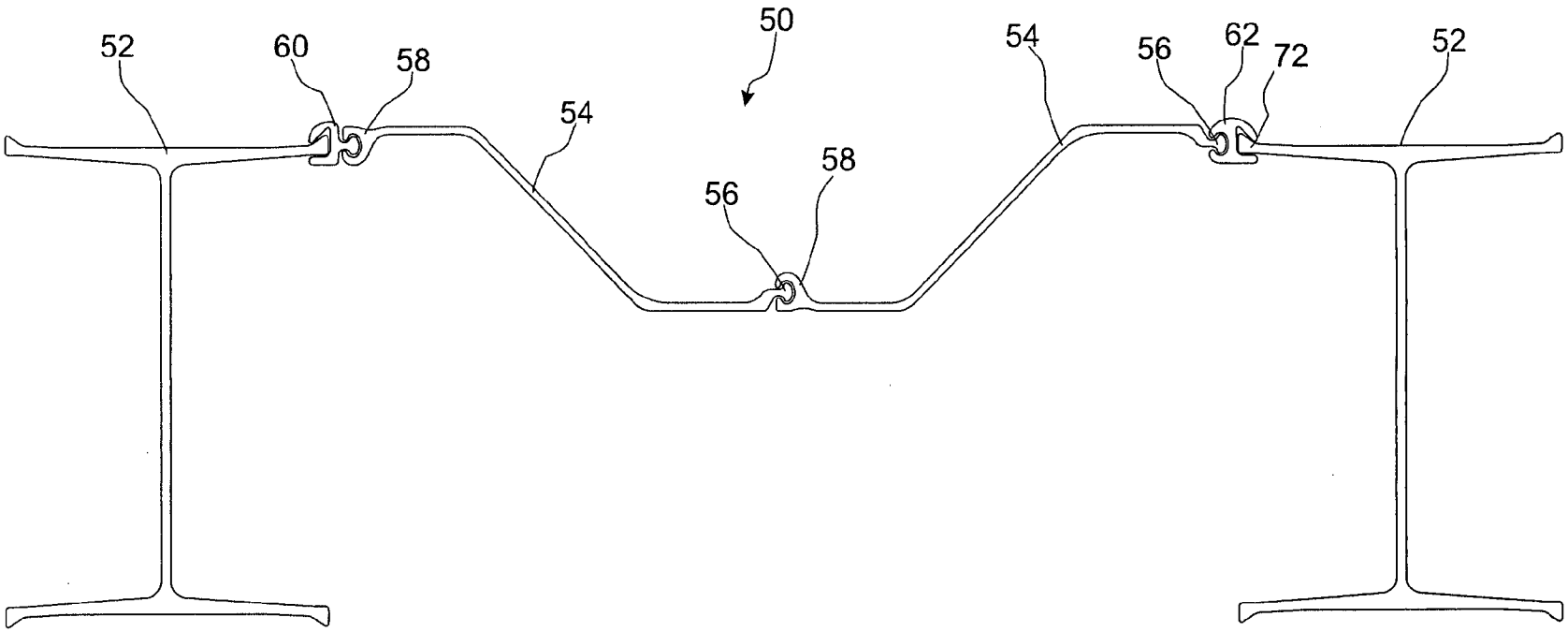
FIG. 4 is a top view of a second embodiment of a wall section of a combination pile wall, according to the invention, consisting of beam carriers and Z-sheet piles.

FIG. 4 shows a second embodiment of a combination pile wall 50 that also is formed of two beam carriers 52 and two sheet piles 54. The two Z-shaped 54 correspond to the previously-described sheet piles 14, but are so constructed that each of the head strips 56 of a sheet pile 54 engages with the C-shaped claw strip 58 of the other sheet pile 54. This allows dispensing with the use of the central slide lock 22 shown for the first embodiment.

The other end of the one sheet pile 54 on which the C-shaped claw strip 58 is also formed is connected with the beam carrier 52 by means of a shaped connection strip 60 that corresponds to the previously described shaped connection strip 16. Here too, the shaped connection strip 60 is of such dimensions that it may be pivoted relative to the beam carrier 52 and relative to each sheet pile 54 through an angular range α or β of at least ±3° and a maximum ±7°.

Figure 5:
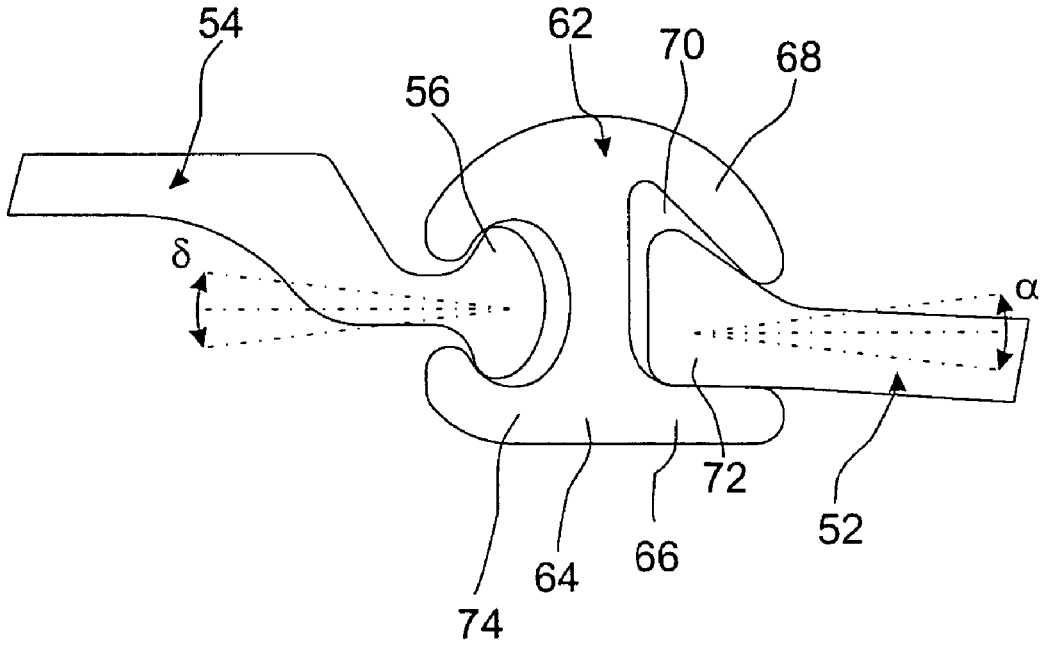
FIG. 5 is an enlarged view of an additional shaped connection strip by means of which one of the Z-sheet piles of the combination pile wall is secured to one of the beam carriers.

The other sheet pile 54 is connected with the beam carrier 52 by means of a second shaped connection strip 62, whose structure will be described in the following in greater detail with reference to FIG. 5.

The second shaped connection strip 62 also possesses a central strip 64 from which a first securing strip 66 projects at a right angle, and from which a second securing strip 68 extends at an angle of about 45°. The two securing strips 66 and 68 form an open, approximately triangular receiver channel 70 to receive the wedge-shaped securing section 72 of the beam carrier 52. Here too, the relative ability of the second shaped connection strip 62 to pivot toward the wedge-shaped securing section 72 of the beam carrier 52 is allowed through an angular cross-section range α of a minimum ±3° to a maximum ±7°.

A C-shaped claw strip 74 is formed on the side of the central strip 64 opposing the receiver channel 70 into which the head strip 56 of the second sheet pile 54 is suspended. The C-shaped claw strip 74 and the head strip 56 are of such dimensions and shape that the sheet pile 56 and the second shaped connection strip 64 may be pivoted with respect to each other through an angular range δ of a minimum ±3° and a maximum ±7°.

Since the various components of the combination pile walls 10 and 50 may be pivoted through limited angular ranges α, β, γ, and δ of a minimum ±3° and a maximum ±7° relative to each other, the components of the combination pile walls 10 and 50 may on the one hand be driven into the ground very exactly, while on the other hand, disengagement of individual engaged locking elements of the components is prevented by their ability to pivot.

The two previously shown sections of the combination pile walls 10 and 50 represent only two of the many possibilities of connecting the beam elements, sheet piles, shaped connection strips, and central slide locks to form combination pile walls. Of course, the optional possibilities of positioning and coupling are almost limitless. Thus, several sheet piles may be positioned between the beam elements. Conventional shaped connection strips whose locking elements do not ensure adequate ability to pivot may be used combined with the shaped connection strips according to the invention. The fact essential to the invention is merely that the locking elements of at least a portion of the shaped connection strips and the locking elements of the pertinent beam elements engaged with them are so shaped that the limited ability to pivot through a pre-determined angle of α, β, γ, or δ is ensured. The permissible pivot angle for this lies in an angular range of a minimum ±3° and a maximum ±10°. In specific cases where very exact construction of the pile wall is desired, the pivot angle should be limited to a minimum range of ±3° and a maximum of ±7°.

There has thus been shown and described a novel combination pile wall which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A combination pile wall comprising a plurality of beam elements, namely, at least one of T-beams and double-T-beams, at least one sheet pile positioned between two adjacent beam elements, and shaped connection strips connecting the sheet pile with the two beam elements, wherein each shaped connecting strip includes a first locking element having two securing strips which project from a central strip of the shaped connection strip between which a corresponding securing section formed on the respective beam element is inserted, and a second locking element that is engaged with a complementary locking element of the sheet pile; the improvement wherein the the two securing strips of the first locking element of the shaped connection strip are arranged such that the first locking element may be pivoted with respect to the securing section of the beam element through an angular range (α) of a minimum ±3° to a maximum ±10°, wherein the ability of the first locking element to pivot is limited when the securing section of the beam element rest against at least two lines of contact at the securing strips of the first locking element, and wherein the second locking element and the complementary locking element of the sheet pile are configured in cross section such that the two locking elements may be pivoted with respect to each other through an angular range (β, χ, δ) of a minimum ±3° to a maximum ±10°.

2. Combination pile wall as defined in claim 1, wherein the the two securing strips of the first locking element and the securing section are so configured that they may be pivoted with respect to each other through an angular range of a minimum ±3° to a maximum ±7°.

3. Combination pile wall as defined in claim 1, the first of the securing strips projects approximately perpendicularly from the central strip of the shaped connection strip, while the second of the securing strips projects toward the first securing strip at an angle to the central strip.

4. Combination pile wall as defined in claim 1, wherein the two securing strips project from a the central strip approximately parallel to each other, between which is inserted a said securing section of the beam element.

5. Combination pile wall as defined in claim 1, wherein the second locking element is formed on the shaped connection strip and the engaged locking elements of the sheet pile are configured in cross section such that said engaged locking elements may be pivoted with respect to each other through an angular range (β, χ, δ) of a minimum ±3° to a maximum ±7°.

6. Combination pile wall as defined in claim 1, wherein the second locking element of the shaped connection strip connecting the beam element with the sheet pile includes a claw strip with C-shaped cross section into which is retained the locking element of the sheet pile, formed as a head strip.

7. Combination pile wall as defined in claim 6, wherein the head strip has an oval cross section.

8. Combination pile wall as defined in claim 1, wherein the second locking element of the shaped connection strip connecting the beam element with the sheet pile possesses a head strip with an oval cross section that is retained in a C-shaped claw strip formed as a locking element of the sheet pile.

9. Combination pile wall as defined in claim 1, further comprising at least two sheet piles positioned between each pair of adjacent beam elements, said sheet piles being connected together by respective locking elements during formation of the pile wall.

10. Combination pile wall as defined in claim 9, wherein at least two of the sheet piles positioned adjacent to one another are connected by means of a central slide lock, the central slide lock being provided with two locking elements that engage with a complementary locking element on each of the adjacent sheet piles.

11. Combination pile wall as defined in claim 10, wherein the locking elements of the central slide lock and the complementary locking elements on the adjacent sheet piles are configured such that the locking elements engaging with one another may be pivoted with respect to each other within an angular range (γ) minimum ±3° to a maximum ±10°.

12. Combination pile wall as defined in claim 11, wherein the angular range (γ) has a minimum ±3° to a maximum ±7°.

13. Combination pile wall as defined in claim 10, wherein the central slide lock includes two claw strips facing in opposing directions and possessing approximately a C-shaped cross section.

14. Combination pile wall as defined in claim 10, wherein the central slide lock includes a connection strip to connect a supporting element of the combination pile wall.

* * * * *